US012611048B2

(12) United States Patent
Grady

(10) Patent No.: US 12,611,048 B2
(45) Date of Patent: Apr. 28, 2026

(54) MATTRESS ASSEMBLIES INCLUDING AN ORTHOTIC LAYER AND PROCESSES FOR FORMING THE SAME

(71) Applicant: DREAMWELL, LTD., Doraville, GA (US)

(72) Inventor: Alex Grady, Atlanta, GA (US)

(73) Assignee: DREAMWELL, LTD., Doraville, GA (US)

( * ) Notice: Subject to any disclaimer, the term of this patent is extended or adjusted under 35 U.S.C. 154(b) by 4 days.

(21) Appl. No.: 17/695,090

(22) Filed: Mar. 15, 2022

(65) Prior Publication Data

US 2023/0292930 A1 Sep. 21, 2023

(51) Int. Cl.
*A47C 27/14* (2006.01)
*A47C 27/15* (2006.01)

(52) U.S. Cl.
CPC ..... *A47C 27/146* (2013.01); *A47C 27/148* (2013.01); *A47C 27/15* (2013.01)

(58) Field of Classification Search
CPC ..... A47C 27/146; A47C 31/12; A47C 27/148; A47C 27/15; A47C 27/142; A47C 27/144; G06Q 30/0621
See application file for complete search history.

(56) References Cited

U.S. PATENT DOCUMENTS 5,671,492 A * 9/1997 Simon ..... A47C 27/15 5/736
2019/0274443 A1* 9/2019 Chan ..... A47C 27/144
2019/0307622 A1* 10/2019 Langer ..... A61G 7/05723
2020/0151284 A1* 5/2020 Winer ..... G06F 16/252

FOREIGN PATENT DOCUMENTS

ES 1061269 U * 1/2006 ..... A47C 27/146
JP 2006325950 A * 12/2006 ..... A47C 27/146
JP 2020031981 A * 3/2020 ..... A47C 27/146
WO WO-2006061449 A1 * 6/2006 ..... A47C 27/146
WO WO-2021045635 A1 * 3/2021

* cited by examiner

*Primary Examiner* — Matthew Troutman
*Assistant Examiner* — Alison N Labarge
(74) *Attorney, Agent, or Firm* — CANTOR COLBURN LLP

(57) ABSTRACT

A mattress assembly generally includes an orthotic layer generated from a deformation map associated with a particular end user and process of manufacturing he mattress assembly. The orthotic layer is rigid and flexible and minimizes pressure points relative the mattress assembly without the orthotic layer.

4 Claims, 2 Drawing Sheets

MATTRESS ASSEMBLIES INCLUDING AN ORTHOTIC LAYER AND PROCESSES FOR FORMING THE SAME

BACKGROUND

The present disclosure generally relates to mattress assemblies, and more particularly, to mattress assemblies including an orthotic layer providing a contoured sleeping surface personalized for a specific end user and processes for personalized fitting of an end user to define the contours of the mattress assemblies.

Mattress assemblies are typically rectangular shaped having planar top and bottom surfaces. These types of mattress assemblies often exhibit uneven pressure distribution and spinal misalignment depending on the quality of mattress construction. Relief can often be addressed with different foams and/or coil systems used in the mattress construction, which can add manufacturing complexity and significant cost increases. Still, even with these types of modifications, relief is generalized and somewhat optimized for all consumers of the mattress assemblies. Personalization is generally not provided, and for most constructions, not economically practical to the bedding manufacturer. Moreover, existing mattress assemblies do a poor job in zoning for different regions of the body. Compression can be a culprit of pain points being created while tension strives to distribute the load.

BRIEF SUMMARY

Disclosed herein are mattress assemblies and processes for manufacturing a mattress assembly.

In one or more other embodiments, a mattress assembly includes a rigid and flexible orthotic layer comprising an elastomeric solid material or a foam having a contoured upper surface translatable to a sleeping surface, wherein the contoured upper surface is configured to minimize pressure points relative to the mattress assembly free of the digid and flexible orthotic layer.

In still one or more other embodiments, a process for manufacturing a mattress assembly includes generating a deformation map from a particular end user, wherein generating the deformation map comprises measuring deformation corresponding to the particular end user on a test mattress including a plurality of pressure sensors; forming an orthotic layer from the deformation map, wherein the orthotic layer bas a contoured surface minimizing pressure points associated with the deformation map, and assembling the mattress assembly including the orthotic layer for the particolar end user wherein the mattress assembly comprises a plurality of layers, wherein the orthotic layer underlies at least one of the plurality of layers and the contoured surface is translatable to the sleeping surface.

The disclosure may be understood more readily by reference to the following detailed description of the various features of the disclosure and the examples included therein.

BRIEF DESCRIPTION OF FIGURES

Referring now to the figures wherein the like elements are numbered alike.

DETAILED DESCRIPTION

Figure 1:
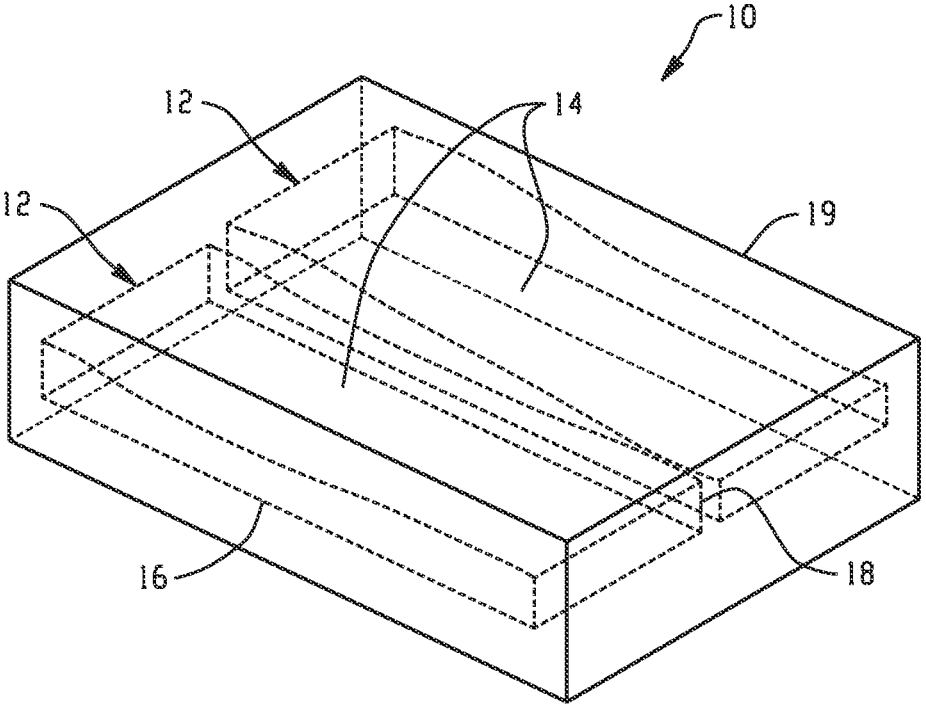
FIG. 1 illustrates a perspective view of a mattress assembly including an orthotic layer in accordance with one or more embodiments of the present disclosure.

Disclosed herein are mattress assemblies including an orthotic layer providing the mattress assemblies with a contoured surface that is translatable to the sleeping surface and processes for personalized fitting of an end user to define the orthotic foam layer. The orthotic layer is personalized to the end user and generally includes a contoured upper surface, a planar or contoured bottom surface, and vertically oriented sidewalls extending from the bottom planar surface to the contoured upper surface. The contoured upper surface is configured to minimize pressure points based on a deformation map personalized to the end user, which is likely different from other end users. One or more comfort layers can overlay the orthotic layer, wherein the contoured surface is translatable to the sleeping surface. The one or more comfort layers can be configured to have a relatively low firmness and thickness so that upon compression by a prone end user, the contoured surface provided by the orthotic layer can be felt by the end user even if the contour is not visibly apparent because of the presence of the one or more comfort layers. The mattress assemblies including the orthotic layer advantageously provide a reduction in pressure points experienced by the end user.

The processes for generating the mattress assemblies including the orthotic layer for providing the contoured surface generally includes generating a deformation map associated with an end user positioned on a test mattress. By way of example, the test mattress can include a plurality of pressure sensors configured to measure and generate the deformation map specific to the end user on the test mattress. A processor is configured to receive the signals from each of the various pressure sensors to generate the deformation map. The deformation map is then used to generate the orthotic layer including a contoured surface personalized to a particular end user. The orthotic layer generated from the deformation map can be configured for back sleepers, side sleepers, and/or stomach sleepers.

Mattress assemblies are then fabricated including at least the orthotic layer, which can further include one or more overlaying comfort layers or underlying layers as may be desired. The resulting mattress assemblies provide a personalized contoured sleeping surface with minimal pressure points for a particular end user. The orthotic layer is generally rectangular shaped having dimensions approximating the width and length of the mattress assembly such as a twin, queen, oversized queen, king, or California king sized mattress assembly, as well as custom or non-standard sizes constructed to accommodate a particular user or a particular room.

In one or more embodiments, the orthotic layer is generally rectangular shaped having dimensions less than the width and/or length of the mattress assembly. As such, the orthotic layer can be positioned in the mattress layer at a location corresponding to a desired sleeping area. For example, in a mattress assembly configured to accommodate two end users, orthotic layers can be customized for at least one or both end users and generally positioned under the respective end location on the mattress when sleeping.

Conventional techniques related to manufacturing processes such as the use of stitching, application of adhesives assembly steps, and the like are well known and so, in the interest of brevity, many conventional steps will only be mentioned briefly herein or will be omitted entirely without providing the well-known process details.

For the purposes of the description hereinafter, the terms "upper", "lower", "top", "bottom", "left," and "right," and derivatives thereof shall relate to the described structures, as they are oriented in the drawing figures. The same numbers in the various figures can refer to the same structural component or part thereof. Additionally, the articles "a" and "an" preceding an element or component are intended to be nonrestrictive regarding the number of instances (i.e., occurrences) of the element or component. Therefore, "a" or "an" should be read to include one or at least one, and the singular word form of the element or component also includes the plural unless the number is obviously meant to be singular.

Spatially relative terms, e.g., "beneath," "below," "lower," "above," "upper," and the like, can be used herein for ease of description to describe one element or feature's relationship to another element(s) or feature(s) as illustrated in the figures.

The following definitions and abbreviations are to be used for the interpretation of the claims and the specification. As used herein, the terms "comprises," "comprising," "includes," "including," "has," "having," "contains" or "containing," or any other variation thereof, are intended to cover a non-exclusive inclusion. For example, a composition, a mixture, process, method, article, or apparatus that comprises a list of elements is not necessarily limited to only those elements but can include other elements not expressly listed or inherent to such composition, mixture, process, method, article, or apparatus.

As used herein, the term "about" modifying the quantity of an ingredient, component, or reactant of the invention employed refers to variation in the numerical quantity that can occur, for example, through typical measuring and liquid handling procedures used for making concentrates or solutions. Furthermore, variation can occur from inadvertent error in measuring procedures, differences in the manufacture, source, or purity of the ingredients employed to make the compositions or carry out the methods, and the like.

It will also be understood that when an element, such as a layer, region, or substrate is referred to as being "on" or "over" another element, it can be directly on the other element or intervening elements can also be present. In contrast, when an element is referred to as being "directly on" or "directly over" another element, there are no intervening elements present, and the element is in contact with another element.

Turning now to FIG. 1, there is depicted a mattress assembly 10 including two orthotic layer 12 adjacent to one another and configured for mattresses dimensioned to accommodate two end users, wherein the form factor for the orthotic layer is exemplary and driven by a deformation map specific to the body type and sleeping position of the end user. Optionally, a single orthotic layer can be utilized for mattresses dimension to accommodate a single end user. The orthotic layers 12 can each include a contoured upper surface 14, a planar (or contoured, not shown) bottom surface 16, and vertically oriented sidewalls 18 extending from the bottom surface 16 to the contoured upper surface 14. Once the form factor is determined, the orthotic layer 12 can be manually slotted, cut or molded to provide the desired curvature. As will be discussed in greater detail below, the form factor is based on a personalized deformation map generated from the particular end user. In one or more embodiments, the mattress assembly 10 consists of one or more of the orthotic layers as generally shown, which can further include a comfort layer 19 including a ticking layer, a fabric layer and/or quilt layer (not shown) encapsulating the orthotic foam layer or layers 12.

Figure 2:
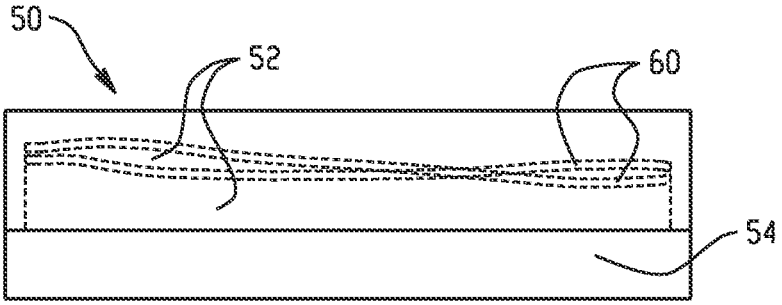
FIG. 2 illustrates a cross sectional view of the mattress assembly including multiple layers, wherein the multiple layers include an orthotic layer in accordance with one or more embodiments of the present disclosure.

In FIG. 2, a side view of a mattress assembly 50 in accordance with one or more embodiments is depicted. The mattress assembly includes at least one base layer 54, one of which is shown, underlying an orthotic layer 52 as generally discussed above. Overlying the orthotic layer 52 are one or more comfort layers 60, one of which is shown. The comfort layer(s) 60 generally conforms to the surface contours of the orthotic layer 52 to provide the mattress assembly with a contoured sleeping surface.

The orthotic layer is not intended to be limited to a specific material so long as it is fairly rigid and maintains the contour surface. Exemplary materials include elastomeric solid materials, foams, or the like. These materials are relatively rigid and in one or more embodiments, have some flexibility. Suitable foams include but are not limited to, polyurethane foams, latex foams including natural, blended and synthetic latex foams; polystyrene foams, polyethylene foams, polypropylene foam, polyether-polyurethane foams, and the like. Likewise, the foam can be selected to be viscoelastic or non-viscoelastic foams. Some viscoelastic materials are also temperature sensitive, thereby also enabling the foam layer to change hardness/firmness based in part upon the temperature of the supported part. Unless otherwise noted, any of these foams may be open celled or closed cell or a hybrid structure of open and closed cells. Likewise, the foams can be reticulated, partially reticulated or non-reticulated foams. The term reticulation generally refers to removal of cell membranes to create an open cell structure that is open to air and moisture flow. Still further, the foams may be gel infused in some embodiments. The different layers can be formed of the same material configured with different properties or different materials.

The various foams suitable for use as the orthotic layer may be produced according to methods known to persons ordinarily skilled in the art. For example, polyurethane foams are typically prepared by reacting a polyol with a polyisocyanate in the presence of a catalyst, a blowing agent, one or more foam stabilizers or surfactants and other foaming aids. The gas generated during polymerization causes foaming of the reaction mixture to form a cellular or foam structure Latex foams are typically manufactured by the well-known Dunlap or Talalay processes. Manufacturing of the different foams are well within the skill of those in the art.

The different properties defining the orthotic layer may include, but are not limited to, density, hardness, thickness, support factor, flex fatigue, air flow, various combinations thereof, and the like Density is a measurement of the mass per unit volume and is commonly expressed in pounds per cubic foot. The density of the layers can generally range from about 1 to 2.5 pounds per cubic foot for non-viscoelastic foams and 1.5 to 6 pounds per cubic foot for viscoelastic foams. The hardness properties of foam are also referred to as the indention load deflection (ILD) or indention force deflection (IFD) and is measured in accordance with ASTM D-3574 The hardness of the layers generally have an indention load deflection (ILD) of 7 to 16 pounds force for viscoelastic foams and an ILD of 7 to 45 pounds force for non-viscoelastic foams. ILD can be measured in accordance with ASTM D 3575.

The orthotic layer can be molded, cut and/or manually slotted to form the desired contoured upper surface.

Figure 3:
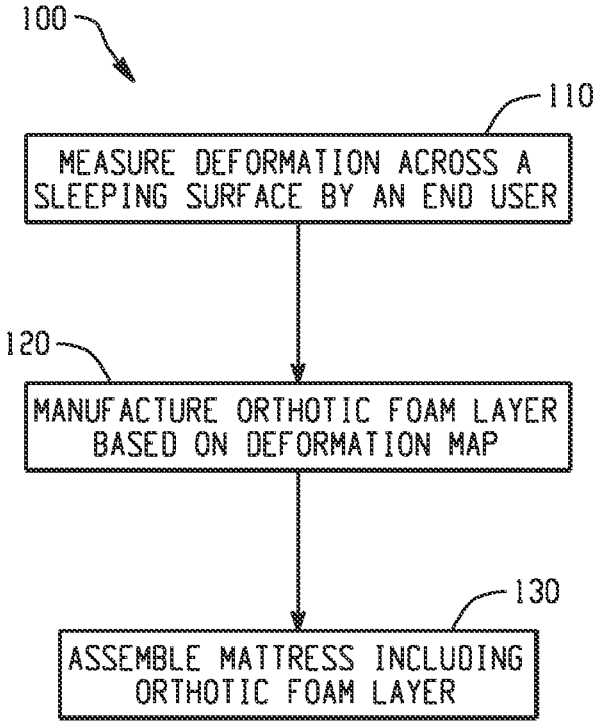
FIG. 3 illustrates a process flow diagram for manufacturing a mattress assembly including an orthotic layer in accordance with one or more embodiments of the present disclosure.

Turning now to FIG. 3, there is depicted an exemplary process 100 for forming an orthotic layer including a contoured surface. The process begins with the generation of a deformation map personalized to a particular end user on a test mattress including a plurality of pressure sensors sufficient to provide the deformation map across the test mattress surface as shown in block 110. The deformation map is representative of body contact pressure of the end user's body weight across the mattress surface in his or hers desired sleeping position. A processor is configured to receive signals from the plurality of sensors to generate the deformation map. The processor analyzes and converts the signals to provide a form factor for the orthotic layer that minimizes the pressure points obtained from the deformation map. Typically, the regions affected by higher pressure often include the buttocks, shoulder and back, which can affect the quality of sleep should these pressure points not be minimized. As such, curvature is typically more pronounced in these high pressure regions relative to other areas. In step 120, the orthotic layer is formed, which, as noted above, can be molded, cut, or manually slotted to provide a desired surface contour based on the form factor associated with the end user in the desired sleeping position. In step 130, a mattress assembly including the orthotic layer is assembled and provided to the end user.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A process for manufacturing a mattress assembly comprising:

generating a deformation map from a particular end user, wherein generating the deformation map comprises measuring deformation corresponding to the particular end user on a test mattress including a plurality of pressure sensors;

forming an orthotic layer from the deformation map, wherein the orthotic layer has a contoured upper surface minimizing pressure points associated with the deformation map, a planar bottom surface and vertical sidewalls extending from the planar bottom surface to the contoured upper surface, and wherein the orthotic layer has a width and/or length dimension less than overall width and length dimensions of the mattress assembly, wherein the orthotic layer is positioned at a desired sleeping area in the mattress assembly; and assembling the mattress assembly including the orthotic layer for the particular end user, wherein the mattress assembly comprises a plurality of comfort layers in addition to the orthotic layer, wherein the orthotic layer underlies at least one of the plurality of comfort layers conforming to the contoured surface of the orthotic layer, wherein the contoured upper surface is translatable to a sleeping surface of the mattress assembly, wherein at least one of the plurality of comfort layers overlying the orthotic layer has a thickness and firmness such that, upon compression by the end user, the contoured surface of the orthotic layer is perceptible at the sleeping surface, thereby providing a personalized contoured sleeping surface with minimal pressure points for the particular end user, and wherein the mattress assembly is dimensioned to simultaneously accommodate two end users, and comprises two orthotic layers arranged adjacent to one another, wherein each of the two orthotic layers are at a location to accommodate each respective end user, and wherein each of the two orthotic layers have different contouring.

2. The process of claim 1, wherein the orthotic layer has an indention load deflection of 7 to 45 pounds-force for non-viscoelastic foams and 7 to 16 pounds-force for viscoelastic foams.

3. The process of claim 1, wherein the orthotic layer comprises an elastomeric solid material.

4. The process of claim 1, wherein the orthotic layer comprises a foam.

* * * * *